US007651588B2

(12) United States Patent
Nakajima et al.

(10) Patent No.: US 7,651,588 B2
(45) Date of Patent: Jan. 26, 2010

(54) DEWATERING AND THICKENING BELT HAVING IMPROVED GUIDE PERFORMANCE AND MANUFACTURING METHOD THEREOF

(75) Inventors: Tatsutoshi Nakajima, Shizuoka (JP); Yoshihisa Kondou, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 322 days.

(21) Appl. No.: 11/634,965

(22) Filed: Dec. 7, 2006

(65) Prior Publication Data

US 2007/0128415 A1 Jun. 7, 2007

(30) Foreign Application Priority Data

Dec. 7, 2005 (JP) ..... 2005-353474

(51) Int. Cl.
*D21C 9/08* (2006.01)

(52) U.S. Cl. ..... 162/55; 162/348; 162/358.4; 162/901; 428/196; 428/193; 427/195; 427/261

(58) Field of Classification Search ..... 162/902, 162/55, 901, 358.4, 348; 428/196, 193; 427/195, 427/261

See application file for complete search history.

(56) References Cited

U.S. PATENT DOCUMENTS 5,039,412 A 8/1991 Marsh
5,558,926 A * 9/1996 Tate et al. ..... 428/193
5,840,378 A * 11/1998 Nagura et al. ..... 428/57

FOREIGN PATENT DOCUMENTS

| | | | |
|---|---|---|---|
| EP | 0341913 | A2 | 11/1989 |
| EP | 0712957 | A2 | 5/1996 |
| JP | 02-014090 | A | 1/1990 |
| JP | 04-361682 | A | 12/1992 |
| JP | 08-144185 | A | 6/1996 |

OTHER PUBLICATIONS

Communication from European Patent Office dated Jul. 23, 2009, containing European Search Opinion and European Search Report of Application No. 06-25-6234 (EPO).

* cited by examiner

*Primary Examiner*—Eric Hug
*Assistant Examiner*—Jacob Thomas Minskey
(74) *Attorney, Agent, or Firm*—Rader, Fishman & Grauer PLLC; Maulin M. Patel

(57) ABSTRACT

A dewatering and thickening belt having an endless fabric woven with synthetic resin filaments, a bending-resistant element and a guide protrusion, wherein the guide protrusion is fusion-bonded to a bending-resistant portion to which the bending-resistant element has been attached so that the outer end portion of the guide protrusion is located inside the end portion of the fabric. The inner end portion of the guide protrusion is located 20 to 50 mm outside the inner end portion of the bending-resistant element.

9 Claims, 3 Drawing Sheets

Relationship between Fabric Stretch and Tension

DEWATERING AND THICKENING BELT HAVING IMPROVED GUIDE PERFORMANCE AND MANUFACTURING METHOD THEREOF

RELATED APPLICATION

This application claims priority from Japanese Patent Application No. 2005-353474 filed Dec. 7, 2005, the contents of which are incorporated herein by reference in their entirety.

BACKGROUND OF THE INVENTION

1. Field of the Invention

The present invention relates to a belt to be used particularly in a washing step for removing ink particles and ash content from an aqueous solution of paper materials regenerated as a result of de-inking or de-ashing of wastepaper such as newspaper or a in a step of dehydrating the aqueous solution or thickening pulp raw materials; and a manufacturing method of the belt.

2. Description of the Related Art

A thickening machine is employed in a washing step for removing ink particles and ash content from an aqueous solution of paper materials regenerated by de-inking or de-ashing of wastepaper such as newspaper and magazine or in a step of dewatering and thickening pulp raw materials.

There are some kinds of thickening machines but any of them has a mechanism of reducing the water content of paper materials or pulp raw materials. One of them is a thickening machine equipped with two rolls and an endless belt which is made of a fabric and suspended on these rolls. In this machine, pulp materials are supplied between these rolls and belt and by the nip pressure between the inner roll and belt and centrifugal force caused by high speed rotation, ink particles, ash content, too minute fibers to form paper, and excess water are removed continuously from an aqueous solution of paper materials.

In paper making, materials are supplied onto a belt uniformly in small portions. In thickening of paper materials such as waste paper, on the other hand, a solid content in the unevenly dispersed form is released onto the belt. A large load is therefore applied unevenly to the fabric and the endless belt may be deformed and torn when the rotating belt travels obliquely. In order to prevent such a phenomenon, an attempt has been made to equip a fabric, at an end portion thereof in a width direction, with a guide protrusion and also with a bending-resistant element for preventing breaking of the fabric on the boundary surface between the guide protrusion and fabric.

In Japanese Patent Laid-Open No. H04-361682 (1992), disclosed is a fabric having a guide and a bending-resistant element fusion-bonded thereto. The thickening belt disclosed herein has a conventionally employed structure and a typical guide-attached portion is shown in FIG. 2 of the document. In spite that the guide protrusion is attached to the belt well, the guide performance of the belt is not still sufficient. The guide protrusion inevitably runs on a roll by wild meandering or this causes breaking of the fabric at the boundary between the bending-resistant element and fabric.

SUMMARY OF THE INVENTION

An object of the present invention is to overcome various problems which cannot be solved by the conventional thickening belts, for example, insufficient guide performance, dropping-off of a guide protrusion, and cutting of the fabric at the boundary between the guide-attached portion and the fabric.

The present invention relates to a dewatering and thickening belt comprising an endless fabric made of a fabric woven by a synthetic resin filament, a bending-resistant element disposed at least one selvage in a width direction of the endless fabric, and a guide protrusion. The bending-resistant element is made of a polyurethane resin having a width of 30 mm or greater from the end portion of the bending-resistant element on the central side, in a width direction, of the endless fabric (which will hereinafter be called "inner end portion) to the end portion of the element on the selvage side of the endless fabric (which will hereinafter be called "outer end portion") and is attached to the fabric by filling the element in at least 85% of the space of the fabric at the selvage thereof to form a bending-resistant portion. The guide protrusion is made of another polyurethane resin having a width from the end portion on the central side, in a width direction, (which will hereinafter be called "inner end portion") of the endless fabric to the end portion on the selvage side (which will hereinafter be called "outer end portion") of the endless fabric. The guide protrusion is attached by fusion bonding to the bending-resistant portion to which the bending-resistant element has been attached so that the inner end portion of the guide protrusion is located outside the inner end portion of the bending-resistant element and the outer end portion of the guide protrusion is located at least Y (mm) inside the end portion of the fabric, the Y representing a value satisfying the following equation:

$$Y = \frac{A \cdot \Delta L}{\pi L}$$

wherein:

Y: a length (mm) from the outer end portion of the guide protrusion to the end portion of the fabric, L: a perimeter (mm) of the belt under no tension,

2A: a length (mm) of a portion of the belt which is not in contact with two rolls when the belt is suspended on the rolls under no tension with substantially no slack between the belt and rolls, and ΔL: a stretch amount (mm) of the fabric constituting the belt.

The guide protrusion may attached to the bending-resistant portion to which the bending-resistant element is attached so that the outer end portion of the guide protrusion is located at least 5 mm inside the end portion of the fabric and the inner end portion of the guide protrusion is located from 20 to 50 mm outside the inner end portion of the bending-resistant element.

The bending-resistant element may be attached so that the outer end portion thereof is located inside the end portion of the fabric. Alternatively, the bending-resistant element may be attached so that the outer end portion thereof is located outside the end portion of the fabric.

The bending-resistant element may be a urethane sheet having a width of from 30 to 70 mm and thickness of from 1 to 3 mm. The urethane sheet bending-resistant element may be bonded by the thermocompression bonding to the fabric. In this case, the urethane sheet is filled in the internal space of the fabric. The bending-resistant element may be non-linear at the inner end portion thereof. The bending-resistance element may be corrugated at the inner end portion thereof. A resin may be applied to the boundary between the inner end portion of the bending-resistant element and the fabric body.

The present invention makes it possible to provide a dewatering and thickening belt superior in guide performance and fixing strength to the conventional belt by fusion bonding the guide protrusion so that within the bending-resistant portion to which the bending-resistant element has been attached, the outer end portion of the guide protrusion is located inside the end portion of the fabric and the inner end portion of the guide protrusion is located at a position outside the inner end portion of the bending-resistant element, which means, at a position at least Y (mm) outside the inner end portion of the bending-resistant element, the Y representing a value satisfying the above-described equation.

DETAILED DESCRIPTION OF THE INVENTION

Figure 1:
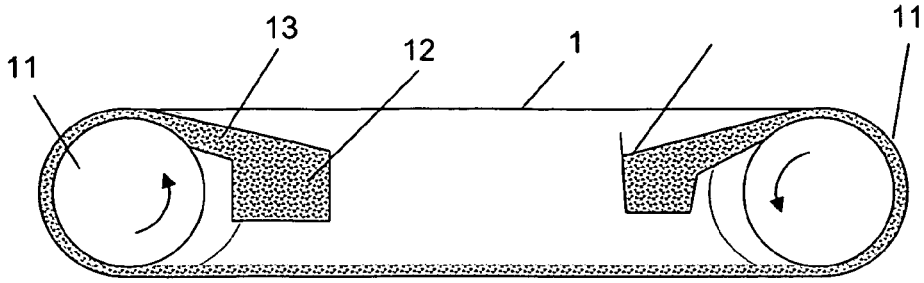
FIG. 1 is a side view of a thickening machine using a dewatering and thickening belt.

The present invention relates to a thickening belt to be used in washing treatment for removing ink particles and ash content from an aqueous solution of paper materials regenerated as a result of de-inking or de-ashing of wastepaper such as newspaper and magazine or a in a thickening machine for dehydrating and thickening the pulp raw materials. The belt has a bending-resistant element and a guide protrusion fixed to at least one selvage, in a width direction, of an endless fabric obtained by making a fabric woven by a synthetic resin filament endless in a known manner.

The term "traveling direction" as used herein means a direction of a belt or fabric and "width direction" means a direction perpendicular to the traveling direction. The traveling direction corresponds to the circumferential direction of the endless fabric. In the description of the fabric, all the terms "end portion in the width direction", "end portion of the fabric", "selvage portion", and "selvage" refer to the same portion. In the description of the bending-resistant element, the terms "inner end portion" and "outer end portion" mean a portion of the bending-resistant element near an area to be dehydrated and thickened and a portion of the element near the selvage of the fabric, respectively. The end portions of the guide protrusion are expressed similarly as "outer end portion" and "inner end portion". With regards to the two sides of the belt, the inside of the endless fabric is called "roll contact surface". The upper and lower portions of the fabric are called "upper side layer" and "lower side layer", respectively, but either may be used as the roll contact surface.

The fabric is not limited insofar as it is made of a synthetic resin filament. Since it is a thickening fabric, it must only have a structure which can retain thereon materials and remove therefrom excess water content, ink particles, ash content and too minute fibers. Examples include single layer fabrics with one warp layer and one weft layer, two-layer fabrics with two warp layers and two weft layers, and fabrics with one warp layer and three weft layers. Fabrics obtained by weaving upper and lower layers with a warp are preferred because they are free from such a phenomenon that loosening of a warp serving as a binding yarn causes friction of upper and lower layers and a portion of yarns appearing from the inside of each layer undergoes internal wear. If materials are supplied to the upper side layer, water and the like are discharged from the lower side layer. It is the common practice to decrease the diameter of yarns constituting the material-supplied surface and thereby form a dense structure in order to retain fibers thereon, and to increase the diameter of yarns constituting the water-exit-side layer and thereby form a rough structure in order to attain smooth water drainage and maintain fabric rigidity. The structure in which two layers composed of upper and lower layers are woven by a binding yarn is preferred because these layers are independent each other to permit selection of fabric designs respectively. An object of the present invention resides in not the formation of a uniform pulp sheet but the formation of a dewatering and thickening belt so that the fabric of the present invention is not required to have complete surface uniformity necessary for paper making fabrics. Even single-layer fabric has sufficient rigidity and fiber supporting property so that it can be used as a thickening belt. In addition, no limitation is imposed on the diameter, design, binding means, and warp:weft arrangement ratio of the fabric of the present invention.

Yarns to be used in the present invention may be selected depending on the using purpose. Examples of them include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square form, short form such as stellar form, or elliptical or hollow form can be used. The material of the yarn can be selected freely and not only ordinarily employed yarns such as polyester and polyamide, but also chemical fibers and synthetic fibers can be used. Of course, yarns obtained using copolymers or mixing the above-described material with a substance selected depending on the intended purpose may be used.

Polyester monofilaments having rigidity and excellent size stability are preferred as warps of the thickening belt. Wefts, on the other hand, may be obtained by combined weaving, for example, by alternately arranging polyester monofilaments and polyamide monofilaments.

The fabric thus woven is made endless in a known manner.

A bending-resistant element is attached to at least one selvage of the fabric thus obtained. The bending-resistant element is attached in order to prevent the breaking of the fabric which will otherwise occur at the boundary between the fabric and a guide protrusion attached thereto or at the contact portion with the end portion of a roll at which the breaking occurs most frequently. The guide protrusion is disposed in order to stabilize the traveling of the belt so that it must have enough rigidity. The guide protrusion attached to the selvage portion of the fabric has higher rigidity than the fabric so that a stress concentrates on the boundary between the guide protrusion and the portion of the fabric to which it has been attached or a portion of the fabric in contact with the end portion of the roll and the fabric is sometimes broken at this portion. The bending-resistant element is attached to prevent this.

The bending-resistant element is made of a polyurethane resin. Especially, ether- or ester-based polyurethane resins are preferred as its material, because they have high strength, have good wear resistance, can be bound well with the fabric, and have flexibility high enough to be smoothly folded back at the inner roll. The bending-resistant element may be seamless along the traveling direction of the fabric, though depending on the rigidity, amount or hardness of the resin. The bending-resistant element cut into pieces of a proper length may be arranged discontinuously in the traveling direction to facilitate smooth folding of the belt.

The bending-resistant element is fixed to the fabric by melting the polyurethane resin and filling it in at least 85% of the space of the fabric. When the space filled with it is less than 85%, the element produces only small bending-resistant effects and fixing strength is insufficient. As the bending-resistant element, a thermoplastic sheet or a thermosetting resin having fluidity may be used. The sheet itself may be fusion-bonded or a resin for fusion bonding the sheet may be filled in the fabric and sheet may be fixed via the resin. The sheet having a thickness of from about 1 mm to 3 mm can be used in consideration of the thickness of the fabric. After the sheet is laid over the fabric while aligning it with the end portion of the fabric, thermocompression bonding is performed to allow the resin to penetrate into the fabric, moreover, to penetrate even to the vicinity of the surface on the reverse side of the fabric. After the bending-resistant element is attached, application of a resin to the boundary between the inner end portion of the bending-resistant element and the fabric itself is preferred because by it, the bending-resistant element can be fixed to the fabric firmly and peeling can be avoided. No limitation is imposed on the kind and application amount of the resin and it may be applied between the boundary surface and the slightly inside thereof.

The bending-resistant element has a width of from 30 to 60 mm. The width of from about 30 to 70 mm is especially preferred. When it has a width less than 30 mm, a load is imposed on the inner end portion of the bending-resistant element and the fabric is broken from this portion similar to a fabric equipped with only a guide. The excessively wider element is not preferred from the standpoint of efficient operation, because the bending-resistant element is attached after water drainage holes for dewatering are filled so that an effective surface area decreases when the element is too wide.

The bending-resistant element may be attached to a position in the vicinity of the end portion of the fabric. It may be attached to both end portions of the fabric or one of them. The precise position is not particularly limited and the outer end portion of the bending-resistant element may be either inside or outside the end portion of the fabric. However, the outer end portion of the bending-resistant element is preferably attached to a position a little outside the end portion of the fabric, because the end portion of the fabric is not exposed from the outside, which eliminates the fear of fray of yarns. Attachment of the outer end portion of the bending-resistant element to a position inside the end portion of the fabric improves guide performance. Details will be described later in the column relating to an attaching position of the guide protrusion. The outer end portion of the bending-resistant element may be aligned with the end portion of the fabric. Such a position may be selected, depending on the kind of the machine or using condition.

With regard to the inner end portion of the bending-resistant element, it may be attached so that the inner end position is located at a position slightly overlapping with the roll. When the inner end portion of the bending-resistant element is outside the end portion of the roll, stress concentrates on this portion and causes breaking of the fabric at the boundary. The bending-resistant element may be linear at the inner end portion, but a corrugated or serrated inner end portion disperses the stress and disturbs breaking of the fabric.

The bending-resistant element may be attached while taking the above-described points in consideration and controlling the attaching position, width and shape.

The bending-resistant element may be attached to either side of the fabric. When the element is attached to the roll contact surface, it can protect the fabric from breaking which will otherwise occur owing to the wear caused by the abrasion with the end portion of the roll. Even if it is attached to the reverse side, filling of a polyurethane resin excellent in rigidity and wear resistance in at least 85% of the inner space of the fabric disturbs bending and prevents wear sufficiently.

The guide protrusion is also made of a polyurethane resin. An ether-based or ester-based polyurethane resin is especially preferred. It is fixed by fusion bonding to the bending-resistant portion to which the bending-resistant element has been attached. The polyurethane resin is employed because it has high strength, has good wear resistance, can be bound well with the fabric, and has high flexibility to facilitate folding-back at the inner roll. The bending-resistant element is fixed by filling a polyurethane resin inside the fabric, but the guide protrusion may be, together with the polyurethane resin thus filled, fixed by fusion bonding. For example, the guide protrusion and the resin can be integrated by overlapping a sheet made of a polyurethane resin, which will be a bending-resistant element, with the fabric, thermocompression bonding them to allow the resin to penetrate into the fabric sufficiently, even into the vicinity of the reverse side of the fabric, thermocompression bonding the guide protrusion made of another polyurethane resin to the fabric from the surface opposite to the sheet-fixed surface of the fabric, and fusion bonding these polyurethane resins into one inside the fabric. Use of the same polyurethane resin for the guide protrusion and for filling in the fabric is preferred because it increases fixing strength. It is also possible to attach, not via the resin, the guide protrusion by fusion bonding to the side on which the bending-resistant element has been disposed.

The guide performance of the guide protrusion is very important. Without the guide protrusion, meandering of the belt occurs, followed by the deformation of the belt. As a result, sufficient dewatering and thickening of paper materials supplied to the belt cannot be accomplished. The guide protrusion disposed at the end portion of the belt disturbs the deviation of the belt to the inner or outer side. In other words, the belt equipped, at the end portion thereof, with the guide protrusion hardly undergoes meandering to an inner side or outer side. If the guide protrusion at the end portion of the belt is bent inward so as to embrace the roll, the guide protrusion does not run on the roll so that it has further improved guide performance.

Described specifically, tension is applied to the belt by two rolls. The belt travels by the rotation of the roll under such a state. When tension is applied, the fabric woven by a filament made of a synthetic resin generally stretches. At the same time, owing to the expansion and contraction force, it tries to contract. In the belt to which tension is applied by two rolls, tension is applied almost uniformly from one end to the other end of the belt in a width direction when the width of the belt is equal to or smaller than the width of the roll. Accordingly, there does not appear a large tension difference in the width direction. When the belt is wider than the roll, on the other hand, a portion of the fabric getting out of the end portion of the roll is not directly suspended on the roll so that nothing stops the contraction force of the fabric. The perimeter of the fabric not supported by the roll therefore contracts and owing to a difference in the perimeter, the belt starts bending inward at the end portion of the roll so as to embrace the roll therein.

Such an action occurs when an endless belt having expansion and contraction properties is suspended on rolls. Even if the belt is equipped with a guide protrusion or bending-resistant element, the fabric constituting the belt bends inward with the end portion of the roll as a boundary so that the fabric together with the guide protrusion attached at the selvage of the belt embraces the roll when the fabric is wider than the roll. In the conventional dewatering and thickening belt as described above, however, meandering of a belt and breaking of the fabric caused thereby occur frequently and there is an eager demand for the development of belts having a higher guide performance.

In the present invention, the guide performance is improved by making use of expansion and contraction properties of a fabric made of a synthetic resin and attaching the guide protrusion so that the fabric exists outside thereof.

In the belt of the present invention having the fabric located outside the guide protrusion similar to another belt made of a synthetic resin, a portion of the fabric from the end portion of the roll to the end portion of the fabric bends inward, with the end portion of the roll as a fulcrum, so that the fabric together with the guide protrusion embraces the roll when tension is applied to the belt. In addition, since the fabric exists outside the guide protrusion, the inward force becomes greater. This makes use of both "the principle of leverage" according to which a greater force is produced at an output point by locating the input point at a position more distant from the fulcrum; and a contraction force of the fabric after stretching. As described above, owing to a contraction force of a portion of the fabric which is not supported by the roll and does not overlap with the guide protrusion, the fabric tries to bend inward from the end portion of the roll as if it embraces the roll. When the end portion of the roll is the fulcrum, the input point of the belt of the present invention is located more distant than that of the conventional belt in which the guide protrusion has been attached to the fabric so as to align the outer end portion of the former to the end portion of the latter. As a result, the inward bending force becomes greater than that of the conventional one and disturbs the guide protrusion from running on the roll. When the outer end portion of the guide protrusion is aligned to the end portion of the fabric, the inward bending force is blocked by the guide protrusion and the fabric does not bend inward easily. It is therefore impossible to improve the guide performance.

The attaching position of the guide protrusion will next be described specifically. By attaching it so that the inner end portion of the guide protrusion is located from 20 to 50 mm outside the inner end portion of the bending-resistant element and the outer end portion of the guide protrusion is located at least Y (mm), the Y being a value satisfying the below-described equation (1), inside the end portion of the fabric, the belt has improved guide performance as described above.

$$Y = \frac{A \cdot \Delta L}{\pi L} \tag{1}$$

In Equation (1) and below-described equations, Y represents a length (mm) from the outer end portion of the guide protrusion to the end portion of the fabric, L represents a perimeter (mm) of the belt under no tension, 2A represents a length (mm) of a portion of the belt which is not in contact with two rolls when the belt is suspended on the rolls under no tension with substantially no slack between the belt and rolls, ΔL represents a stretch amount (mm) of the fabric when tension adequate for use is applied, D represents the diameter (mm) of the roll, LS represents a perimeter (mm) of the belt when tension adequate for use is applied, and LT represents a perimeter (mm) of the end portion of the fabric not supported by the roll, of the belt to which tension upon use is applied. A right value of A can be introduced from the belt length and the perimeter of the roll.

Figure 5:
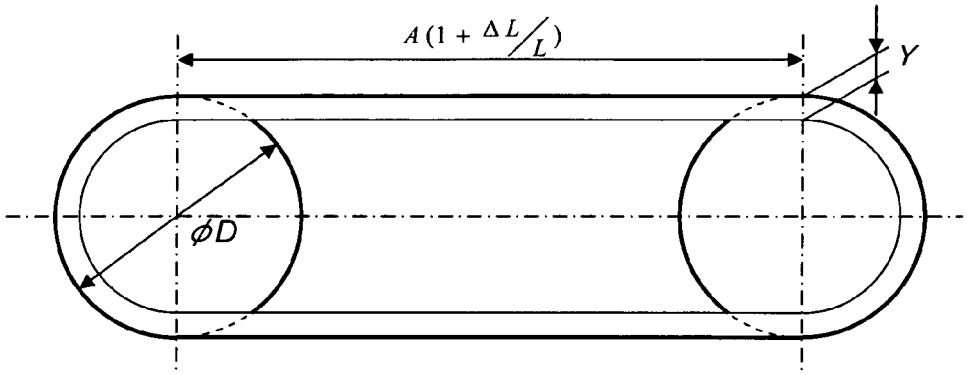
FIG. 5 is a side view of a belt suspended on two rolls.

To describe specifically, each length is roughly shown in FIG. 5. Equations (2) to (6) for deriving Equation (1) therefrom are shown below. To facilitate comparison with a belt of the conventional art, the description is made assuming that the fabric of the present invention bends inward at the outer end portion of the guide protrusion.

First, a perimeter L (mm) of the belt under no tension is determined. The L can be determined from the sum of a length 2A of a portion of the belt which is not in contact with two rolls when the belt is suspended on the rolls under no tension with substantially no slack therebetween and a length πD of a portion of the belt in contact with the roll.

$$L=2A+\pi D \tag{2}$$

In the next place, a perimeter LS (mm) of the belt to which a tension adequate for use has been applied is determined. In general, belts have a property of extending to a direction to which a tension is applied so that the belt becomes longer by the stretch amount ΔL of the belt than the belt under no tension as shown in Equation (3).

$$L_S=L+\Delta L \tag{3}$$

As described above, in the belt of the present invention having the fabric located outside the guide protrusion, a portion of the fabric located outside the guide protrusion bends inward as if it embraces the roll therein and because of the tension, the perimeter of the end portion of the fabric is shorter than the perimeter of the outer end portion of the guide protrusion. A perimeter LT (mm) of the end portion of the fabric at that time is represented by the following equation (4):

$$\begin{aligned} L_T &= 2A\left(1+\frac{\Delta L}{L}\right)+(D-2Y)\pi \\ &= L+2A\frac{\Delta L}{L}-2Y\pi \end{aligned} \tag{4}$$

The belt is supported directly by two rolls and tension is applied onto the belt. The tension on a portion of the fabric located outside, in the width direction, of the guide protrusion becomes smaller from the outer end portion of the guide protrusion to the outside thereof. At the end portion of the fabric, which is the endmost portion of the belt, tension is presumed to be substantially zero. As a result, Equation (5) holds.

$$L=L_T \tag{5}$$

Substitution of Equation (4) into Equation (5) gives the following Equation (6):

$$\begin{aligned} L &= L+2A\frac{\Delta L}{L}-2Y\pi \\ Y &= \frac{1}{2\pi}\left(2A\frac{\Delta L}{L}\right) \end{aligned} \tag{6}$$

-continued $$= \frac{A \cdot \Delta L}{\pi L}$$

Equation (1) is obtained when a solution to Y is found from Equation (6).

$$Y = \frac{A \cdot \Delta L}{\pi L} \tag{1}$$

Y represents a length (mm) from the outer end portion of the guide protrusion to the end portion of the fabric. The Y determined in accordance with this equation is a length necessary for improving the guide performance under the conditions. In other words, the guide performance will be improved by attaching the guide protrusion so that the outer end portion of the guide protrusion is located at least Y (mm) inside the end portion of the fabric.

Figure 6:
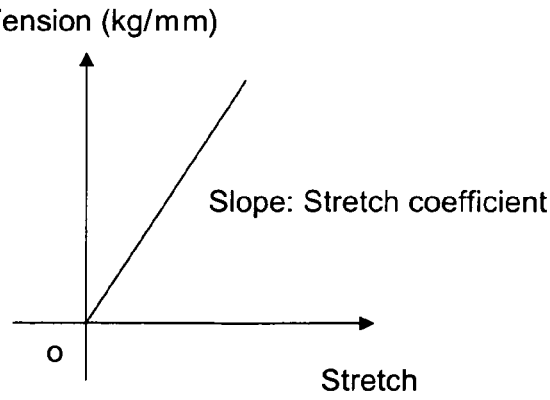
FIG. 6 is a schematic view of expansion and tension of a fabric.
Figure 7:
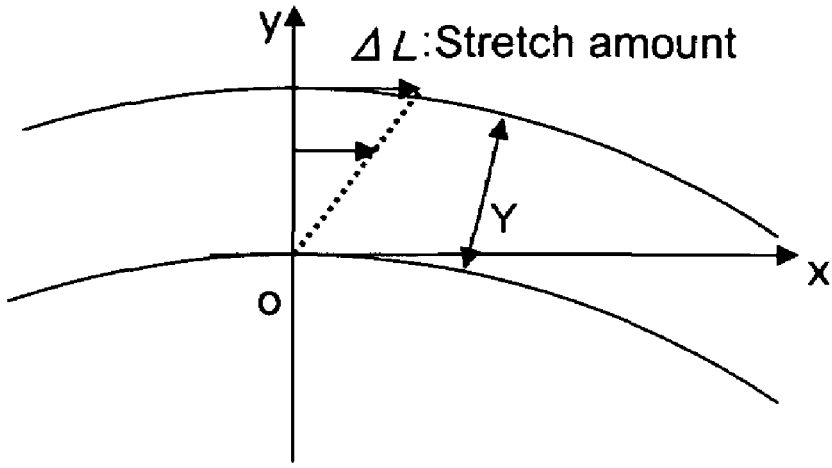
FIG. 7 is a schematic view of a stretch amount of a fabric from the outer end portion of the guide protrusion to the end portion of the fabric.
Figure 8:
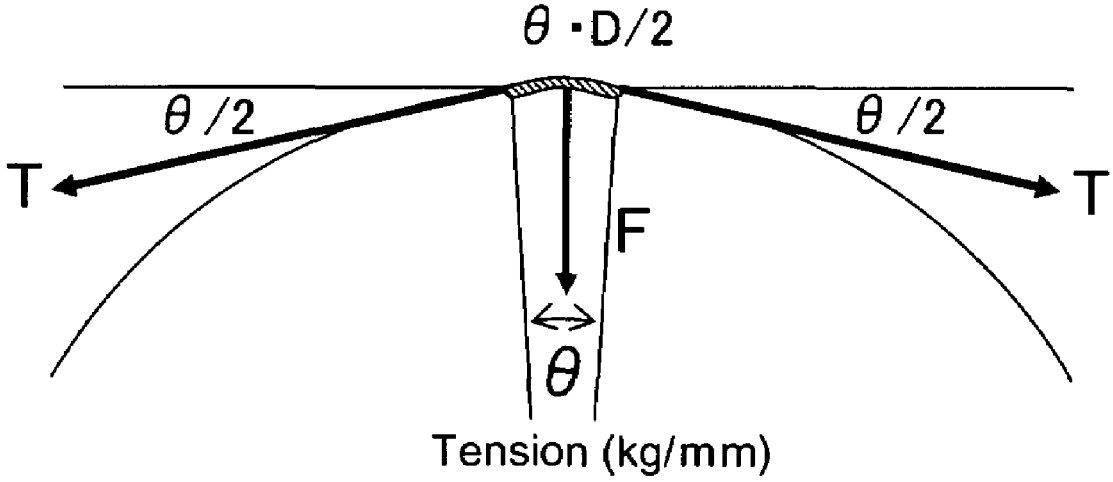
FIG. 8 is a schematic view of force F at an infinitesimal length.

The improvement degree of the guide performance when the guide protrusion is attached under such conditions will next be explained. Prior to explanation, t, x and ξ are set to represent tension of the fabric (kg/mm), stretch amount (variable: mm) of the fabric when tension adequate for use is applied, and stretch coefficient of the fabric, respectively. Graphs and diagrams are shown in FIGS. 6 to 8 in order to explain the inward bending force of the fabric from the outer end portion of the guide protrusion. For convenience of explanation, it is assumed that equal tension works at the outer end portion of the guide protrusion and the portion of the fabric supported by the rolls.

Equation (7) can be derived from the graph of FIG. 6 in which the relation between the expansion of the fabric and tension has been approximated.

$$t = \epsilon \cdot X \tag{7}$$

From the above assumption, tension becomes maximum at the outer end portion of the guide protrusion and the stretch amount ΔL at that time also becomes maximum. Both the tension and stretch amount of the fabric decrease from the outer end portion of the guide protrusion to the end portion of the fabric. Finally, the tension becomes zero at the end portion of the fabric which is the outermost portion of the belt and accordingly, the stretch amount of the fabric also becomes zero. A change in the stretch between the outer end portion of the guide protrusion and the end portion of the fabric is shown as a dotted line in FIG. 7. FIG. 7 illustrates a portion on the roll illustrated in FIG. 5 and an axis y extends toward the central direction of the roll. In FIG. 7, the stretch amount of the end portion of the fabric is set at 0 on the axis y, while the stretch amount of the outer end portion of the guide protrusion is set at the maximum. ΔL shows stretch amount.

The relation of the stretch amount of the fabric shown by a dotted line is represented by the following equation (8), wherein Y represents a length of the fabric from the outer end portion of the guide protrusion to the end portion of the fabric. According to this equation, the expansion of the fabric is x at a point y.

$$x = \frac{\Delta L}{Y} y \tag{8}$$

The substitution of Equation (8) into Equation (7) gives Equation (9). The tension t as determined by this equation is tension on one point on one line toward the central direction of the roll and it means tension on the point y in FIG. 7.

$$t = \varepsilon \frac{\Delta L}{Y} y \tag{9}$$

The sum of the tensions exerted on the line from the outer end portion of the guide to the end portion of the fabric is then determined. Since the length from the outer end portion of the guide protrusion to the end portion of the fabric is Y, the sum of the tensions exerted on this length from 0 to Y can be derived making use of the following equation (9):

$$\begin{aligned} T &= \varepsilon \int_0^Y \frac{\Delta L}{Y} y dy \\ &= \frac{\varepsilon \cdot \Delta L}{Y} \left[ \frac{y^2}{2} \right]_0^Y \\ &= \frac{\varepsilon \cdot \Delta L Y}{2} \end{aligned} \tag{10}$$

Supposing that the total tension T determined from Equation (10) is imposed on the outer end portion of the guide protrusion, how much this total tension becomes the force P heading in the central direction of the roll is then determined. As the force P is greater, the force heading in the central direction of the roll is greater and this means that the guide protrusion does not run on the roll easily.

In order to determine the force P, force F at an infinitesimal length at which the belt is in contact with the roll is determined. The term "infinitesimal length" means the length "θ·D/2" of the circumferential portion at a roll angle θ as illustrated in FIG. 8.

$$F = 2T \sin\left(\frac{\theta}{2}\right) \tag{11}$$

The above equation can be approximated to Equation (12) because the θ/2 is sufficiently small.

$$\sin\left(\frac{\theta}{2}\right) = \frac{\theta}{2} \tag{12}$$

Substitution of Equation (12) into Equation (11) gives Equation (13).

$$F = T\theta \tag{13}$$

The force P heading in the central direction of the roll can be determined by dividing the force F by the infinitesimal length so that the force P can be represented by the following Equation (14).

$$P = \frac{F}{\theta \cdot D/2} = \frac{T\theta}{\theta \cdot D/2} = \frac{2T}{D} \tag{14}$$

Equation (10) is then substituted into Equation (14).

$$P = \frac{2T}{D} = \frac{2 \cdot \frac{\varepsilon \Delta LY}{2}}{D} = \frac{\varepsilon \Delta LY}{D} \quad (15)$$

The force P of the fabric heading toward the center of the roll at the outer end portion of the guide protrusion can be determined from Equation (15). If the guide protrusion is attached to align the outer end portion thereof to the end portion of the fabric, the inward force P making use of the expansion and contraction force of the fabric does not act fully, resulting in failure in the improvement of the guide performance. Such a force acts owing to the existence of the stretch fabric outside the guide protrusion.

It has been found from the above description that the belt can have improved guide performance by attaching the guide protrusion so that the outer end portion thereof is located at least Y (mm), the Y representing a value satisfying the equation (1), inside the end portion of the fabric. Theoretically, it is only necessary to attach the guide protrusion at a position at least Y (mm), as determined in the above equation (1), inside the end portion of the fabric. The condition however differs depending on the arrangement position of the bending-resistant element. In consideration of the ordinary dewatering and thickening machine to be employed in practice, the above-described theory can be at least satisfied by locating the outer end portion of the guide protrusion at least 5 mm inside the end portion of the fabric and locating the inner end portion of the guide protrusion 20 to 50 mm outside the inner end portion of the bending-resistant element.

Without attaching the outer end portion of the guide protrusion at least Y mm inside the end portion of the fabric, the length of the fabric existing outside the guide protrusion is too small so that the resulting belt cannot exhibit a particular guide performance. Without attaching the inner end portion of the guide protrusion at least 20 mm outside the inner end portion of the bending-resistant element, the bending-resistant portion does not overlap with a portion at which breaking tends to occur most frequently such as a boundary between the inner end portion of the guide protrusion and fabric or a portion of the fabric in contact with the end portion of the roll. As a result, the bending or breaking of the fabric cannot be prevented. When the guide protrusion is attached so that the inner end portion of the guide protrusion is located at least 50 mm outside the inner end portion of the bending-resistant element, an effective surface area decreases, leading to deterioration in operation, because the bending-resistant element is attached after water drainage holes for dewatering are filled. Moreover, it may increase the meandering space and deteriorate the guide performance.

The fabric width, roll width, attaching position of the guide protrusion, and attaching position of the bending-resistant element must therefore be determined in consideration of the balance among all of them.

The shape of the guide protrusion is not limited insofar as it can serve as a guide for preventing the meandering of the belt and that having a rectangular, circular or triangle cross-section can be used. The guide protrusion may be in the form of one rod or in the form of some rods, but the protrusion in the form of some separated rods enables smooth folding-back at the inner roll.

EXAMPLES

The present invention will hereinafter be described specifically based on accompanying drawings.

FIG. 1 is a side view of a thickening machine using the dewatering and thickening belt of the present invention. The dewatering belt 1 is suspended over two rolls 11 under tension. An aqueous solution 12 of paper materials is supplied between the rolls 11 and belt 1 from a material supply port 13. By making use of a nip pressure between the inner rolls 11 and belt 1 and centrifugal force caused by high speed rotation, ink particles, ash content, fibers too minute to form paper, and excess water are removed from the aqueous solution of paper materials continuously. In paper making, materials are supplied uniformly onto a belt in small portions. In thickening of paper materials such as waste paper, on the other hand, a solid content is released in the unevenly dispersed form on the belt. When a large load is imposed on the fabric unevenly and the endless belt which is rotating travels obliquely, the belt is sometimes torn as a result of deformation.

Example 1

Figure 2:
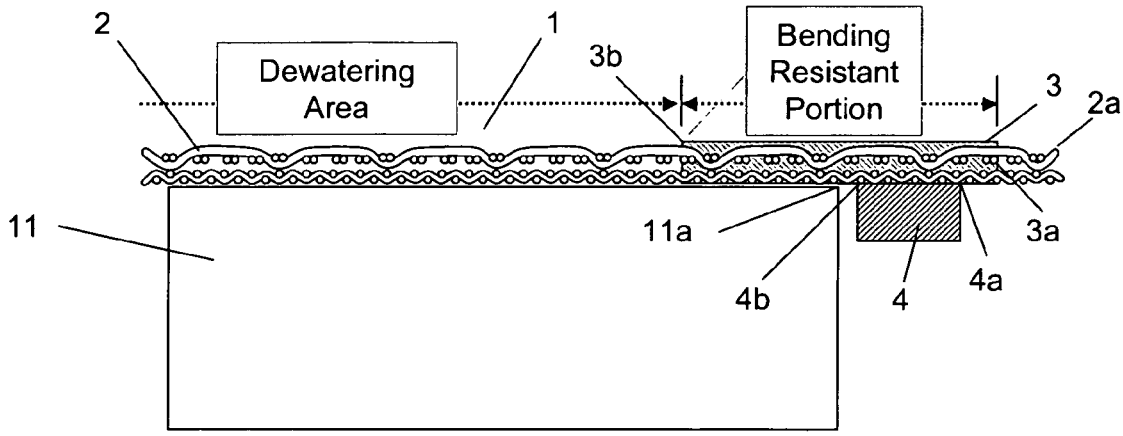
FIG. 2 is a detail view illustrating the selvage of the belt of the present invention suspended on a roll.

Referring to FIG. 2, a guide protrusion 4 is disposed in the vicinity of the end portion of a fabric 2 and, in order to prevent breaking of the fabric at the boundary surface between the guide protrusion and fabric, a bending-resistant element 3 is disposed and forms a bending resistant portion. The bending-resistant element 3 and guide protrusion 4 are fusion bonded to both selvages of the fabric.

In this Example, a polyurethane resin sheet (not shown) which will be the bending-resistant element 3 is overlapped with the fabric on the rough side thereof and melted by thermocompression to allow the resin to penetrate into the fabric, even to the vicinity of the fabric surface on the opposite side. A guide protrusion 4 formed by molding of a polyurethane resin is thermocompression bonded to the fabric surface on the side opposite to the sheet-bonded side, and these polyurethane resins are fusion bonded into one inside the fabric. The belt of the present invention is used for dewatering of an aqueous solution of paper materials so that the fabric used for the belt preferably has an upper layer and lower layer as illustrated in FIG. 2. It is usually preferred that one of the layers has a dense structure made of yarns having a small diameter so as to enable retention of the fibers thereon, while the other layer has a rough structure made of yarns having a large diameter so as to improve water drainage property and keep the rigidity of the fabric.

As illustrated in FIG. 2, the inner end portion 3*b* of the bending-resistant element 3 is located at a position slightly overlapping with the roll 11 whereas the outer end portion 3*a* of the bending-resistant element 3 is located at a position outside the roll end portion 11*a*. If the inner end portion 3*b* of the bending resistant element 3 exists outside the roll end portion 11*a*, the fabric may be broken owing to the stress concentration on the boundary therebetween.

Figure 3:
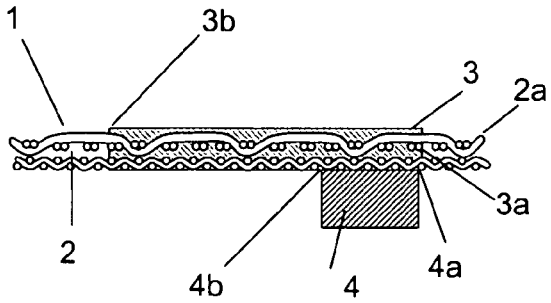
FIG. 3 is a detail view illustrating the selvage of a belt according to another example of the present invention.
Figure 4:
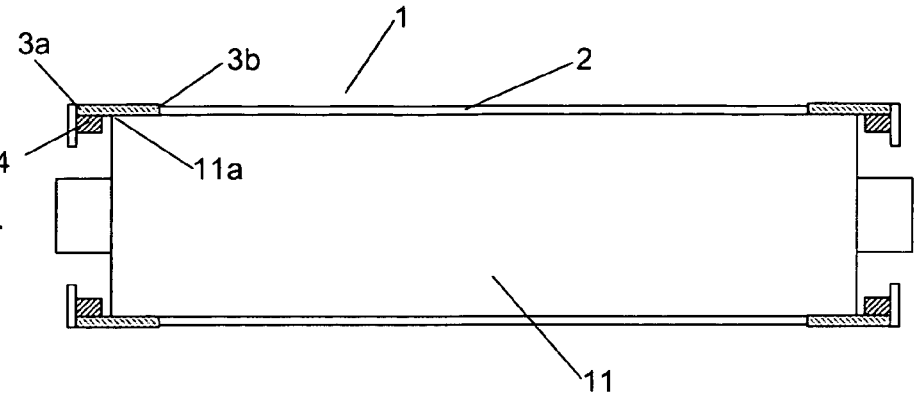
FIG. 4 is a cross-sectional view of the belt of the present invention suspended on roll.

FIG. 3 shows another example of the dewatering and thickening belt of the present invention. FIG. 2 illustrates the belt in which the outer end portion 4*a* of the guide protrusion 4 is located inside the outer end portion 3*a* of the bending-resistant element 3. As illustrated in FIG. 3, however, the outer end portion 4*a* of the guide protrusion may be aligned to the outer end portion 3*a* of the bending-resistant element 3. The guide protrusion 4 must be attached so that, within the bending-resistant portion having the bending-resistant element 3 attached thereto, the outer end portion 3*a* is located inside of the end portion 2*a* of the fabric 2 and the inner end portion 4*b* of the guide protrusion 4 is located from 20 to 50 mm outside the inner end portion 3*b* of the bending-resistant element 3.

In a thickening belt 1 having a guide protrusion 4 and bending-resistant element 3 attached thereto, when the fabric is suspended on rolls 11, it tries to contract by the expansion and contraction force. The fabric corresponding to a portion outside the roll end portion 11*a* is not suspended directly on the rolls 11 so that a portion of the fabric 2 from the roll end portion 11*a* to the end portion 2*a* of the fabric 2 bends inward with the portion of the roll end portion 11*a* as a fulcrum as if the fabric 2, together with the guide protrusion 4, embraces the rolls 11. In addition, in the belt 1 according to the present invention, since the fabric 2 exists outside the guide protrusion 4, the inward force becomes greater. Such a force appears by making use of both "the principle of leverage" according to which a greater force is produced at an output point by locating an input point at a position more distant from the fulcrum; and a contraction force of the fabric after expansion. As described above, a portion of the fabric which is not supported by the rolls and does not overlap with the guide protrusion also tries to bend inward as if it embraces the rolls. Supposing that the roll end portion is the fulcrum, the input point of the belt of the present invention is located more distant than that of the conventional belt in which the guide protrusion has been attached to the fabric so as to align the outer end portion of the former to the end portion of the latter. As a result, the inward bending force becomes greater than that of the conventional one and disturbs the guide protrusion from running on the roll. When the outer end portion of the guide protrusion is aligned to the end portion of the fabric or the outer end portion of the guide protrusion is located outside the end portion of the fabric, a stretch fabric serving as an input point does not exist at a more distant position so that the inward bending force becomes smaller than that of the belt of the present invention and therefore, improvement of the guide performance is difficult.

The attaching position of the guide protrusion is simulated by inserting in Equation (1) respective numerals of the real machine.

Y: a length (mm) from the outer end portion of the guide protrusion to the end portion of the fabric.

L: a perimeter (mm) of the belt under no tension. L=6140

2A: a length (mm) of a portion of the belt which is not in contact with two rolls when the belt is suspended on the rolls under no tension with substantially no slack between the belt and rolls. A=1500

ΔL: a stretch amount (mm) of the fabric constituting the belt. ΔL=30.7 mm $$Y = \frac{1500 \times 30.7}{3.14 \times 6140} = 2.39$$

A dewatering and thickening belt superior in guide performance and fixing strength to the conventional thickening belt can be obtained by fixing the guide protrusion to the fabric by fusion bonding so that the outer end portion of the guide protrusion is located at least 2.39 mm inside the end portion of the fabric and the inner end portion of the guide protrusion is located from 20 to 50 mm outside the inner end portion of the bending-resistant element.

A comparison test of guide performance was carried out by changing the attaching position of the guide protrusion. In order to compare only the guide performance, the test was conducted under similar conditions except for the positions of the guide protrusion and the bending-resistant element. A thickening machine as illustrated in FIG. 1 was employed. An aqueous solution of paper materials such as wastepaper was supplied between inner rolls and belt and it was dewatered and thickened by press and centrifugal dewatering. The guide performance was evaluated by suspending each of the belts of this example and conventional example on the rolls of the thickening machine, supplying irregular amounts of paper raw materials which were not uniform but contained some masses of the materials onto the belt, and observing the guide performance particularly when meandering occurred.

Example 2

A belt was manufactured in a similar manner to that employed in Example 1 by using the belt as illustrated in FIG. 2 except that the width of the bending-resistant element was 50 mm; the outer end portion of the guide protrusion was located 10 mm inside the end portion of the fabric; and the outer end portion of the bending-resistant element was located 5 mm inside the end portion of the fabric.

Conventional Example 1

A belt was manufactured in a similar manner to that employed in Example 1 except that the width of the bending-resistant element was 50 mm and the outer end portion of the guide protrusion, the outer end portion of the bending-resistant element, and the end portion of the fabric were arranged in alignment.

(Evaluation Results of Guide Performance)

The belt of the present example and belt of the conventional example were used in a dewatering and thickening machine under substantially equal conditions. In each example, supply of a relatively large mass of paper materials caused meandering of the belt due to the weight of the materials, but the meandering of the belt obtained in the present example disappeared after a while by the existence of the guide protrusion so that it was used under good conditions for several months. On the other hand, the meandering of the belt of the conventional example which had been caused by the supply of a mass of paper materials was straightened first several times. After that, however, the guide protrusion ran on the roll and the fabric was torn at the boundary with the inner end portion of the bending-resistant element and became unusable.

The above test results have revealed that the guide protrusion can exhibit excellent guide performance by changing the arrangement position.

The present invention provides a belt for removing ink particles and ash content from an aqueous solution of paper materials regenerated as a result of de-inking or de-ashing of wastepaper such as newspaper, dehydrating the aqueous solution or concentrating pulp raw materials. Without causing separation of the fabric, breaking of the fabric, and dropping-off of the guide protrusion, it can be suitably used particularly in a washing or thickening machine for dehydrating or thickening of wastepaper.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A dewatering and thickening belt comprising an endless fabric woven by synthetic resin filaments, a bending-resistant element disposed at a selvage of the endless fabric, and a guide protrusion disposed at the salvage, wherein:

the bending-resistant element has an inner end portion at an inner side end of the element and an outer end portion at an outer side end of the element, wherein the bending-resistant element is made of a polyurethane resin having a width of 30 mm or greater, measured in a width direction from the inner end portion to the outer end portion, and is attached to the fabric by filling the element into at least 85% of the space of the fabric at the selvage to form a bending-resistant portion;

the guide protrusion is made of polyurethane resin having a width from an inner end portion on the central side, in a width direction, of the endless fabric to an outer end portion on the selvage side of the endless fabric; further wherein the guide protrusion is attached by fusion bonding to the bending-resistant portion so that the inner end portion of the guide protrusion is located outside the inner end portion of the bending-resistant element and the outer end portion of the guide protrusion is located at least Y (mm) inside an end portion of the fabric, the Y representing a value satisfying the following equation (1):

$$Y = \frac{A \cdot \Delta L}{\pi L} \quad (1)$$

wherein:

Y is a length (mm) from the outer end portion of the guide protrusion to the fabric end portion and is greater than zero, L is a perimeter (mm) of the belt under no tension,

2A is a length (mm) of a portion of the belt which is not in contact with two rolls when the belt is suspended on the rolls under no tension with substantially no slack between the belt and rolls, and ΔL is a stretch amount (mm) of the fabric constituting the belt.

2. A dewatering and thickening belt according to claim 1, wherein the guide protrusion is attached to the bending-resistant portion so that the outer end portion of the guide protrusion is located at least 5 mm inside the end portion of the fabric and the inner end portion of the guide protrusion is located from 20 to 50 mm outside the inner end portion of the bending-resistant element.

3. A dewatering and thickening belt according to claim 1, wherein the bending-resistant element is attached to the fabric so that the outer end portion of the bending-resistant element is located inside the end portion of the fabric.

4. A dewatering and thickening belt according to claim 1, wherein the bending-resistant element is attached to the fabric so that the outer end portion of the bending-resistant element is located outside the end portion of the fabric.

5. A dewatering and thickening belt according to claim 1, wherein the bending-resistant element is a urethane sheet having a width of from 30 to 70 mm and thickness of from 1 to 3 mm and by the thermocompression bonding of the urethane sheet to the fabric, the sheet is filled into the internal space the fabric.

6. A dewatering and thickening belt according to claim 1, wherein the bending-resistant element is non-linear at the inner end portion thereof.

7. A dehydrating or thickening belt according to claim 6, wherein the bending-resistance element is corrugated at the inner end portion thereof.

8. A dehydrating or thickening belt according to claim 1, wherein a resin is applied to the boundary between the inner end portion of the bending-resistant element and the fabric body.

9. A manufacturing method of a dehydrating or thickening belt as claimed in claim 1, which comprise fusion-bonding the bending-resistant element and guide protrusion to at least one selvage of an endless fabric made of a fabric woven by a synthetic resin filament.

* * * * *